166-273 SR
11/15/83 OR 4,415,032

United States Patent [19] [11] 4,415,032
Shu [45] Nov. 15, 1983

[54] CARBONATED WATERFLOODING FOR VISCOUS OIL RECOVERY USING A $CO_2$ SOLUBILITY PROMOTER AND DEMOTER

[75] Inventor: Winston R. Shu, Dallas, Tex.

[73] Assignee: Mobil Oil Corporation, New York, N.Y.

[21] Appl. No.: 372,370

[22] Filed: Apr. 27, 1982

[51] Int. Cl.[3] ..... E21B 43/20; E21B 43/22
[52] U.S. Cl. ..... 166/273; 166/266
[58] Field of Search ..... 166/273, 274, 275, 272, 166/266

[56] References Cited

U.S. PATENT DOCUMENTS 2,875,831 3/1959 Martin et al. ..... 166/275 X
3,135,326 6/1964 Santee ..... 166/273 X
3,207,217 9/1965 Woertz ..... 166/273
3,442,332 5/1969 Keith ..... 166/272 X
3,800,874 4/1974 Kern ..... 166/273 X
3,882,940 5/1975 Carlin ..... 166/273
4,380,266 4/1983 Wellington ..... 166/274 X

*Primary Examiner*—Stephen J. Novosad
*Attorney, Agent, or Firm*—Alexander J. McKillop; James F. Powers, Jr.; Lawrence O. Miller

[57] ABSTRACT

Viscous oil is recovered from a subterranean, viscous oil-containing formation by injecting a slug of $CO_2$ carbonated water containing a $CO_2$ solubility promoter, a slug of a $CO_2$ solubility demoter, and a water drive to displace the mobilized oil to a production well for recovery.

8 Claims, 1 Drawing Figure

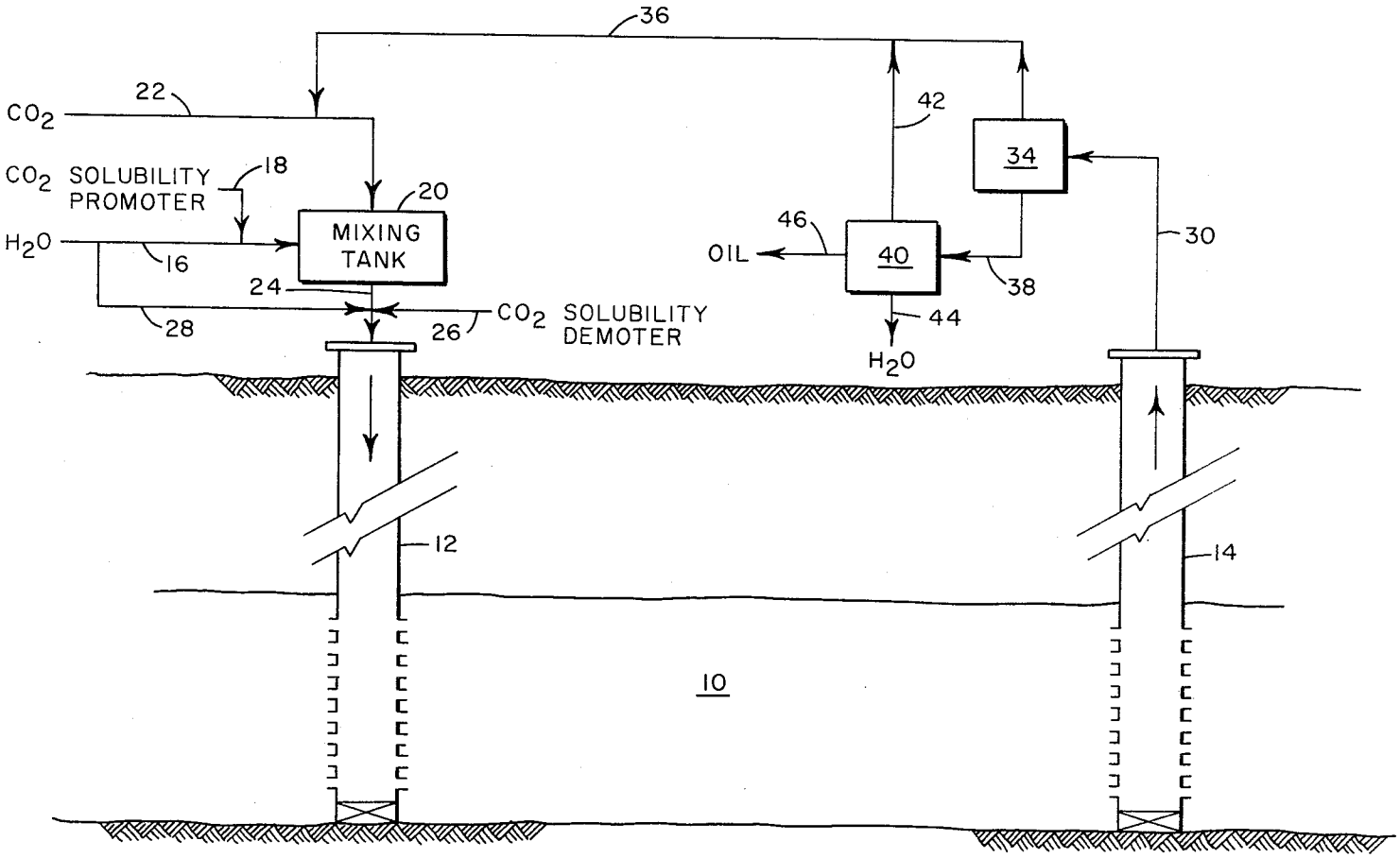
30
34
38
42
40
44
$H_2O$
46
OIL
36
SOLUBILITY DEMOTER
$CO_2$
26
20
MIXING TANK
24
18
SOLUBILITY PROMOTER
22
16
28
$CO_2$
$CO_2$
$H_2O$
14
12
10

CARBONATED WATERFLOODING FOR VISCOUS OIL RECOVERY USING A $CO_2$ SOLUBILITY PROMOTER AND DEMOTER

FIELD AND BACKGROUND OF THE INVENTION

1. Field of the Invention

This invention relates to a method for recovering oil from a subterranean, viscous oil-containing formation by injecting a slug of $CO_2$ carbonated water containing a $CO_2$ solubility promoter to increase the amount of $CO_2$ injected into the formation, injecting a slug of a $CO_2$ solubility demoter into the formation to decrease the solubility of the $CO_2$ in the aqueous slug thereby increasing the amount of $CO_2$ available for reducing oil viscosity and injecting water to displace the mobilized oil toward a production well for recovery.

2. Background of the Invention

A variety of supplemental recovery techniques have been employed in order to increase the recovery of oil from subterranean formations. These techniques include thermal recovery methods, waterflooding and miscible flooding.

Fluid drive displacement of oil from an oil-containing formation utilizing $CO_2$ is known to have the following effect in enhancing the recovery of viscous oils: (1) oil swelling, (2) viscosity reduction and (3) when dissolved in an aqueous driving fluid, it dissolves part of the formation rock to increase permeability. As the oil viscosity increases, a straightforward $CO_2$ immiscible flood becomes less effective because of gravity override and viscous fingering due to unfavorable mobility ratio as disclosed in the article by T. M. Doscher et al, "High Pressure Model Study of Oil Recovery by Carbon Dioxide", SPE Paper 9787, California Regional Meeting, Mar. 25–27, 1981. In such cases, carbonated waterflood has been found to be more effective, both in the laboratory tests and through computer simulation studies as set forth in a paper by L. W. Holm, "$CO_2$ Requirements in $CO_2$ Slug and Carbonated Water Oil and Recovery Processes", *Producers Monthly,* September 1963, p. 6, and a paper by M. A. Klins et al, "Heavy Oil Production by Carbon Dioxide Injection", CIM Paper 81-32-42, 83rd Annual Meeting, Calgary, May 3–6, 1981. However, the solubility of $CO_2$ in water is quite limited and it decreases with the salinity of the water as disclosed in the aforementioned article by L. W. Holm. As a result, carbonated-water projects generally were not successful because of the insufficient transfer of $CO_2$ from water to oil.

The present invention provides a method for increasing the amount of $CO_2$ available in the formation to enhance recovery of oil by first increasing the solubility of $CO_2$ in carbonated water injected into the formation and subsequently injecting a $CO_2$ solubility demoter to release $CO_2$ from the injected carbonated water.

SUMMARY

This invention relates to an improved method for recovering viscous oil from a subterranean, viscous oil-containing formation by injecting $CO_2$ carbonated water having increased $CO_2$ solubility and subsequently injecting a $CO_2$ solubility demoter to release $CO_2$ into the formation thereby increasing the amount of $CO_2$ available for absorption by the oil to reduce its viscosity and also increase the permeability of the formation. Greater amounts of $CO_2$ available to the formation oil enhance oil recovery by a subsequent water drive. First, a predetermined amount of $CO_2$ carbonated water containing a $CO_2$ solubility promoter is injected into the formation via an injection well. The addition of the $CO_2$ solubility promoter increases the solubility of $CO_2$ in the carbonated water thereby more effectively utilizing the water as a means for injecting the maximum amount of $CO_2$ into the formation. A portion of the $CO_2$ in the injected fluid is released and absorbed by the oil, thereby reducing its viscosity. Thereafter, a predetermined amount of a $CO_2$ solubility demoter is injected into the formation to release additional $CO_2$ from the injected water into the formation which dissolves in the oil to further reduce its viscosity. In addition, formation minerals are dissolved in the carbonated water which results in increased permeability. Water is then injected into the formation to drive the mobilized oil toward a production well from which it is recovered. The water drive is continued until the production of oil is unfavorable.

BRIEF DESCRIPTION OF THE DRAWING

The attached drawing depicts a subterranean, viscous oil-containing formation being subjected to the process of my invention.

DESCRIPTION OF THE PREFERRED EMBODIMENTS

Referring to the drawing, a subterranean, viscous oil-containing formation 10 is penetrated by at least one injection well 12 and at least one spaced-apart production well 14. Both the injection well 12 and the production well 14 are perforated to establish fluid communication with a substantial portion of the viscous oil-containing formation 10.

The first step comprises injecting water via line 16 and a $CO_2$ solubility promoter via line 18 into a mixing tank 20. The concentration of the promoter is within the range of 10 to 30 weight %. The mixture of water and $CO_2$ solubility promoter is saturated with $CO_2$ under pressure injected into mixing tank 20 via line 22. The temperature of the absorption of $CO_2$ in such solutions is in the range of 70° to 250° F., depending upon the promoter. The pressure for absorption of $CO_2$ in such solutions is preferably at least 250 psi. Usually, the $CO_2$ saturation pressure is the pressure required to inject fluid into the formation 10 via injection well 12 which will vary from 100 to about 4000 psig depending upon formation conditions. The $CO_2$ solubility promoter reacts with the $CO_2$ in the carbonated water and substantially increases $CO_2$ solubility. Suitable $CO_2$ solubility promoters include mono-ethanolamine, diethanolamine, ammonia, sodium carbonate, potassium carbonate, sodium hydroxide, potassium hydroxide, potassium phosphate, diaminoisopropanol, methyl diethanolamine, triethanolamine or other weak base chemicals. The rate of reaction is a function of the temperature, the concentration of $CO_2$ and the particular $CO_2$ promoter used. Use of these type chemicals to promote $CO_2$ solubility in water is a well-known industry practice in gas absorption technology. See, for example, R. H. Perry and C. H. Chilton (editors) "Chemical Engineering Handbook", 5th edition, Section 14, McGraw-Hill (1973). As an illustration, the $CO_2$ solubility in water is 38 SCF/BBL at 100° C. and 440 psia. Under identical conditions, however, a bbl of 15 weight % monoethanolamine aqueous solution will absorb 260 SCF of $CO_2$ which is a 7-fold increase.

A predetermined amount of the carbonated water containing the $CO_2$ solubility promoter is then injected into the formation 10 via line 24 and injection well 12. The amount of carbonated water containing the $CO_2$ solubility promoter may vary within relatively wide limits, and primarily depends on the solubility of $CO_2$ in the water and in the reservoir oil. The primary objective is to make available the $CO_2$ required to sufficiently reduce the viscosity of the oil for maximum recovery. In practice, the injected carbonated water should not be less than 0.5 pore volume under the flood pattern. The carbonated water containing the $CO_2$ solubility promoter invades the formation and mixes with formation water thereby reducing the concentration of the $CO_2$ solubility promoter. As the slug travels away from the injection well, the fluid pressure also decreases, thus causing a portion of the $CO_2$ to be released because of reduced solubility which dissolves in the oil, reducing its viscosity and thereby enhancing its recovery. Some formation minerals such as dolomites are also dissolved by the released $CO_2$ which results in an increase of formation permeability that enhances oil recovery.

After a predetermined amount of carbonated water containing a $CO_2$ solubility promoter has been injected into the formation 10 via injection well 12, a predetermined amount of an aqueous solution of a $CO_2$ solubility demoter from line 26 is injected into the formation via the injection well. The amount of $CO_2$ solubility demoter injected will vary depending upon the amount of $CO_2$ carbonated water containing a $CO_2$ solubility promoter previously injected. The $CO_2$ solubility demoter invades the formation reducing the solubility of $CO_2$ releasing additional $CO_2$ from the carbonated water. The released $CO_2$ dissolves in the oil causing swelling and further viscosity reduction. Injection of the $CO_2$ solubility demoter subsequent to injection of the slug of carbonated water containing a $CO_2$ solubility promoter increases the amount of available $CO_2$ in the formation to be absorbed by the oil thereby resulting in a greater decrease in oil viscosity and enhanced oil recovery. In the case that amines are used as $CO_2$ solubility promotors, the amines recovered after releasing $CO_2$ may act as surfactants which desorb the crude from sand matrix and emulsify it in the basic aqueous solution, which gives added improvement in recovery. Suitable $CO_2$ solubility demoters include any weak acids, preferably acids commonly used for well stimulation in the petroleum industry such as hydrochloric, acetic and hydrofluoric acids.

After the $CO_2$ solubility demoter has been injected into the formation, a driving fluid comprising water is injected via line 28 and injection well 12 into the formation 10 and the mobile oil is displaced through the formation toward production well 14 where fluids including oil and carbonated water are recovered via line 24. The produced fluids are then passed into a suitable gas-liquid separator 34 wherein gaseous $CO_2$ is withdrawn from separator 34 through line 36 and recycled to mixing tank 20 through line 22. The liquid oil and water is removed from separator 34 through line 38 and sent to a heater treater 40 to effect separation of the oil from the water and also separate any gaseous $CO_2$ carried over with the water from separator 34. Gaseous $CO_2$ recovered from hot separator 40 is removed through line 42 and recycled to mixing tank 20 via lines 36 and 22. Water is recovered from hot separator 40 through line 44 and oil is recovered through line 46. Injection of water into the formation 10 via injection well 12 is continued until the amount of oil recovered from the formation via production well 14 is unfavorable.

In another embodiment of the invention, injection of the driving fluid comprising water may be periodically terminated and a slug of carbonated water containing $CO_2$ solubility promoter may be injected into the formation followed by a slug of an aqueous solution of $CO_2$ solubility demoter. The sequence of carbonated water/$CO_2$ solubility promoter injection followed by injection of a slug of $CO_2$ solubility demoter, followed by a water drive may be repeated for a plurality of cycles.

In another embodiment of the invention, the carbonated water with $CO_2$ promoter may be used as the driving fluid and periodically terminate the injection of the carbonated water and inject a slug of $CO_2$ solubility demoter solution. In all cases, the $CO_2$ dissolved in the produced oil and water from production well 14 is recovered at the surface in both the gas-liquid separater 34 and the heater treater 40.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn at al. By the term "pore volume" as used herein, is meant that volume of the portion of the formation underlying the well pattern employed, as described in greater detail in the Burdyn et al. patent.

From the foregoing specification one skilled in the art can readily ascertain the essential features of this invention and without departing from the spirit and scope thereof can adapt it to various diverse applications. It is my intention and desire that my invention be limited only by those restrictions or limitation as are contained in the claims appended immediately hereinafter below.

What is claimed is:

1. A method for the recovery of viscous oil from a subterranean, viscous oil-containing formation penetrated by at least one injection well and at least one spaced-apart production well, said injection well and said production well in fluid communication with a substantial portion of the formation, comprising:

(a) injecting into the formation via said injection well a predetermined amount of a fluid comprising water containing a $CO_2$ solubility promoter and saturated at the injection pressure with carbon dioxide;

(b) injecting a predetermined amount of an aqueous solution of a $CO_2$ solubility demoter into the formation via said injection well;

(c) injecting a driving fluid comprising water into the formation via said injection well; and (d) recovering fluids including oil from the formation via said production well.

2. The method of claim 1 wherein the $CO_2$ solubility promoter is selected from the group consisting of monoethanolamine, diethanolamine, ammonia, sodium carbonate, potassium carbonate, sodium hydroxide, potassium hydroxide, potassium phosphate, diaminoisopropanol, methyl diethanolamine, and triethanolamine.

3. The method of claim 1 wherein the $CO_2$ solubility demoter is a weak acid selected from the group consisting of hydrochloric, acetic and hydrofluoric acids.

4. The method of claim 1 wherein the steps of (a), (b) and (c) are repeated for a plurality of cycles.

5. The method of claim 1 wherein the driving fluid during step (c) is carbonated water containing a $CO_2$ solubility promoter.

6. The method of claim 1 wherein the water injected during step (a) contains 10 to 30 weight % of a $CO_2$ solubility promoter and is saturated with $CO_2$ at a temperature of 70° to 250° F. and at a pressure of at least 250 psi.

7. The method of claim 1 further including the step of separating $CO_2$ from the recovered fluids and recycling the $CO_2$ to form carbonated water.

8. The method of claim 1 wherein the amount of carbonated water containing a solubility promoter injected during step (a) is not less than 0.5 pore volume.

* * * * *